US007213796B2

(12) United States Patent
Laforest

(10) Patent No.: US 7,213,796 B2
(45) Date of Patent: May 8, 2007

(54) LINEAR ACTUATOR WITH RELEASABLY INTERLOCKING BANDS

(75) Inventor: Pierre Laforest, Montreal (CA)

(73) Assignee: Gestion Laforest Inc., St.-Hubert, Québec (CA)

( * ) Notice: Subject to any disclaimer, the term of this patent is extended or adjusted under 35 U.S.C. 154(b) by 431 days.

(21) Appl. No.: 10/880,563

(22) Filed: Jul. 1, 2004

(65) Prior Publication Data

US 2006/0005651 A1 Jan. 12, 2006

(51) Int. Cl.
*B66F 3/08* (2006.01)

(52) U.S. Cl. ..... 254/1; 254/89 R; 254/97

(58) Field of Classification Search ..... 254/1, 254/29 R, 97, 98, DIG. 6; 74/500.5; 52/10, 52/108

See application file for complete search history.

(56) References Cited

U.S. PATENT DOCUMENTS

| | | | |
|---|---|---|---|
| 1,570,429 | A | 1/1926 | Bonnet |
| 2,130,993 | A | 9/1938 | Dubilier |
| 2,173,685 | A | 9/1939 | Grassmann et al. |
| 2,265,892 | A | 12/1941 | Bloch |
| 2,269,363 | A | 1/1942 | Farrand |
| 2,574,657 | A | 11/1951 | Pierce |
| 2,946,556 | A | 7/1960 | Edgerton |
| 3,016,988 | A | 1/1962 | Browing |
| 3,503,164 | A | 3/1970 | Berry et al. |
| 4,875,660 | A | 10/1989 | Gagnon et al. |
| 5,005,436 | A | 4/1991 | Brusasco |
| 5,056,278 | A | 10/1991 | Atsukawa |
| 5,249,396 | A | 10/1993 | Zuse |
| 6,112,474 | A | 9/2000 | Paine |
| 6,224,037 | B1 | 5/2001 | Novick |
| 6,428,419 | B1 | 8/2002 | Sheldon |

FOREIGN PATENT DOCUMENTS

| | | |
|---|---|---|
| CA | 391718 | 3/1932 |
| DE | 241789 | 12/1911 |
| DE | 1225839 | 12/1911 |
| DE | 547836 | 9/1966 |
| GB | 1331910 | 9/1973 |

*Primary Examiner*—Robert C. Watson
(74) *Attorney, Agent, or Firm*—Louis Martineau

(57) ABSTRACT

The linear actuator comprises an elongated first band wound in helical form about a central axis and capable of taking a retracted position and an extended position with its turns spaced from one another in the direction of the central axis, and first fasteners carried by the first band and longitudinally disposed therealong. The linear actuator also comprises an elongated second substantially flat band wound on itself, with its turns substantially transversely parallel to the central axis, and capable of taking a retracted, spiral position with its turns nested within one another and an extended position with its turns forming a helix around the central axis and generally equally radially spaced therefrom to form a telescopic column, the first and second bands, when in retracted position, in respective locations so as to clear each other. Second fasteners are carried by the second band and longitudinally disposed therealong, the second fasteners capable of cooperating with the first fasteners to releasably interlock the first and second bands. A spacer successively spaces the turns of the first band. A powered drive causes relative rotation on one hand of the first and second bands and on the other hand of the spacer about the central axis. Guide means guide the turns of the second band towards the turns of the first band to releasably interlock the first and second fasteners. A retaining member retains the first and second fasteners in interlocked fashion in the telescopic column.

34 Claims, 10 Drawing Sheets

LINEAR ACTUATOR WITH RELEASABLY INTERLOCKING BANDS

FIELD OF THE INVENTION

The present invention relates to a linear actuator, and more particularly to a linear actuator with releasably interlocking bands that form a retractable telescopic column.

BACKGROUND OF THE INVENTION

U.S. Pat. No. 4,875,660 issued in 1989 to the inventors Pierre GAGNON and Pierre LAFOREST (the inventor of the present invention), hereafter the "Gagnon patent" which is hereby incorporated to the present specification by way of reference, shows a push actuator to be used as a pushing device, for example instead of a hydraulic cylinder. The push actuator of the Gagnon patent has the advantage of requiring less space than conventional hydraulic cylinders when in a contracted position, due to the fact that no concentric column portions have to be stored within each other. Also, it can support very heavy loads, since it forms a cylindrical column when in an extracted position, without any concentric portions as with a hydraulic cylinder, and this vertical structure has a high vertical rigidity in compression. Very important world-wide commercial success of the push actuator of the Gagnon patent has proven it to be a very advantageous alternative to conventional hydraulic cylinders.

The Gagnon push actuator generally works as follows. A hollow cylindrical rotor is rotatably carried over a base fixed to the ground. A motor selectively activates the rotor. A first horizontal band is vertically stacked in a helix and rests on the ground, while a second vertical band is horizontally stacked in a spiral, the latter located in an annular magazine located co-axially around the rotor. The upper end of each band is fixedly attached to a load-bearing platform. When the rotor is rotated, each turn of the vertical band is guided and installed in helical configuration between two vertically successive turns of the horizontal band, to thus gradually form a vertical telescopic column. The load of the platform supported by the push actuator is induced through the vertical and horizontal band turns which rest on each other, and then to idle rollers provided on the rotor which support the horizontal band.

One problem associated to the push actuator of the Gagnon patent is that the horizontal and vertical bands simply rest on each other without being interlocked in any way. This is not problematic when a load is applied on the push actuator platform both axially and in compression, since the push actuator has a very important vertical load-bearing capacity. However, the structural integrity of the column is likely to be compromised if a force is exerted on the column perpendicularly to its central axis. Indeed, in such a case, the two intertwined bands of the column may accidentally disengage themselves from one another, which would lead to the column collapsing. To circumvent this problem, the push actuator of the Gagnon patent is usually used together with guiding devices, such as scissor-type linkages, that prevent lateral movement of the load carried by the push actuator. Indeed, the scissor-type linkages will only allow the load being carried to be moved in the direction of the axis of the push actuator. Also, it can be seen that the vertical column of the Gagnon push actuator may not be submitted to any type of tension force, since once again the two intertwined bands would disengage themselves from each other and the column would collapse.

SUMMARY OF THE INVENTION

The present invention relates to a linear actuator comprising:

an elongated first band wound in helical form about a central axis and capable of taking a retracted position and an extended position with its turns spaced from one another in the direction of said central axis;

first fastening means carried by said first band and longitudinally disposed therealong;

an elongated second substantially flat band wound on itself, with its turns substantially transversely parallel to said central axis, and capable of taking a retracted, spiral position with its turns nested within one another and an extended position with its turns forming a helix around said central axis and generally equally radially spaced therefrom to form a telescopic column, said first and second bands, when in retracted position, in respective locations so as to clear each other;

second fastening means carried by said second band and longitudinally disposed therealong, said second fastening means capable of cooperating with said first fastening means to releasably interlock said first and second bands;

spacer means to successively space the turns of said first band;

drive means to cause relative rotation on one hand of said first and second bands and on the other hand of said spacer means about said central axis;

guide means to guide the turns of said second band towards the turns of said first band to releasably interlock said first and second fastening means; and retaining means retaining said first and second fastening means in interlocked fashion in said telescopic column.

In one embodiment, each said two consecutive turns of said second band that form said retractable telescopic column partly overlap to form an overlapping section, with a portion of said first band being wound in a helix adjacent to said overlapping section and with said first and second fastening means engaging each other at said overlapping section to releasably link said each two consecutive turns of said second band that form said retractable telescopic column.

In one embodiment, said first fastening means comprise longitudinally spaced-apart teeth protruding from said first band, and said second fastening means comprise openings longitudinally disposed along said second band and positioned in said each two consecutive turns of said second band that form said retractable telescopic column so as to register in said overlapping section by pairs, with at least some of said pairs of openings being engaged by corresponding said teeth.

In one embodiment said retaining member and said guiding member are a roller mounted to said rotor.

In one embodiment, said second band is preformed in an inclined configuration so that each turn defines a slightly conical shape.

In one embodiment, said linear actuator further comprises a first anti-rotation member attached to either one of said structural and first bands and engaging a second anti-rotation member attached to said frame, wherein said structural and first bands are prevented from rotating.

In one embodiment, said teeth are also first anti-rotation members that cooperate with second anti-rotation members provided on said frame in spaced-apart fashion around said central axis, with at least one of said teeth engaging a corresponding space defined between two said second anti-rotation members at all times, wherein said structural and first bands are prevented from rotating while they are moved between their extended and retracted positions.

In one embodiment, said drive means includes a power driven rotor rotatably mounted to a first frame portion, said rotor carrying said guide means, said retaining means and said spacer means, said linear actuator also comprising a second band magazine movable relative to said rotor and said frame and carrying the portion of said second band which is in said retracted, spiral position with its turns nested within one another, said first and second elongated bands having a first end located near said first frame portion and a second end attached to a second frame portion.

In one embodiment, said spacer means includes a support member having a helical configuration, carried by said rotor and engaged by a portion of said first band.

In one embodiment, said support member is a helical groove.

In one alternate embodiment, said linear actuator further comprises:

a first frame portion carrying said spacer means, said guide means, said retaining means and a second band magazine movable relative to said first frame portion and carrying the portion of said second band which is in said retracted, spiral position with its turns nested within one another; and a second frame portion, with said drive means including a power driven rotor fixedly attached to a first end of said first and second bands and rotatably carried by said second frame portion.

In one embodiment, said spacer means includes a support member having a helical configuration, carried by said first frame portion and engaged by a portion of said first band.

In one embodiment said support member is a helical groove made in said first frame portion.

The present invention also relates to an elongated linear actuator having opposite first and second ends and an intermediate portion between said first and second ends, said linear actuator further defining a central axis extending between said first and second ends and comprising:

a frame comprising a first frame portion at said first end and a second frame portion at said second end movable relative to said first frame portion between retracted and extracted positions, with said second frame portion being closer to said first frame portion in said retracted position than in said extracted position;

a rotor member rotatably carried by said first frame portion and rotatable about said central axis;

drive means, capable of selectively rotating said rotor member relative to said first frame portion;

a first elongated band wound according to a helical pattern about said central axis, having a first end portion adjacent to said linear actuator first end and a second end portion attached to said second frame portion, and comprising longitudinally disposed releasable fasteners;

a second elongated substantially flat band substantially parallel to said central axis and wound about said central axis in a helical configuration between said intermediate portion and said second end and in a spiral configuration between said intermediate portion and said first end, said second band having a first end portion adjacent to said linear actuator first end and a second end portion attached to said second frame portion;

a support member carried by said rotor in a helical pattern about said central axis, with part of said first band movably engaging said support member and allowing rotation of said rotor member relative to said first band;

a guiding member at said linear actuator intermediate portion and carried by said rotor member, said guiding member guiding said second band in a transition between its said spiral and helical configurations, said guiding member guiding each turn of said second band substantially edgewisely adjacent to the preceding turn of said second band between said intermediate portion and said second end when said rotor member is rotated in a first direction around said central axis, with said fasteners of said first band engaging and releasably linking each two consecutive turns of said second band between said intermediate portion and said second end thus forming a retractable telescopic column composed of the releasably interconnected first and second bands between said intermediate portion and said second end, with said first and said second bands each being independently stackable between said intermediate portion and said first end; and a retaining member retaining said first and second bands in their releasably interconnected relationship between said intermediate portion and said second end.

The present invention further relates to a linear actuator having a central axis and comprising:

a frame including spaced-apart and distinct first and second frame portions;

an elongated fastening band comprising a first portion of variable length stacked in a helical configuration and a second portion of variable length also having a helical configuration, said fastening band further comprising longitudinally disposed first releasable fastening means and having a first end located near said first frame portion and a second end attached to said second frame portion;

an elongated substantially flat structural band having its turns generally parallel to said central axis and comprising a first portion of variable length stacked in a spiral pattern separately from said fastening band and having a first end located near said first frame portion, a second portion of variable length having a helical configuration and having a second end attached to said second frame portion, and second releasable fastening means that can cooperate with said first fastening means to releasably interlock said structural and fastening bands;

a support member carried by said first frame portion and forming a helical pattern about said central axis, with part of said fastening band movably engaging said support member whilst allowing relative rotation of said support member relative to said fastening band;

a guiding and retaining member mounted to first frame portion; and drive means to cause relative rotation on one hand of said fastening and horizontal bands and on the other hand of said support member about said central axis; wherein upon relative rotation on one hand of said fastening and structural bands and on the other hand of said support member in a first direction, a retractable telescopic column is formed with the second portions of said fastening and structural bands, by said fastening band being lifted and its turns being spaced through its engagement on said support member, and by each turn of said structural band being guided by said guiding and retaining member into an edgewisely adjacent configuration with respect to the preceding turn of said vertical band to form a substantially continuous cylindrical wall of said column, with said first and second fastening means engaging each other to releasably link each two successive turns of the second portion of said structural band with a corresponding turn of said fastening band, and with said guiding and retaining member retaining said first and second fastening means in their engagement at said each two successive turns of the upper portion of said structural band;

and wherein upon rotation of said rotor in the direction opposite said first direction, said retractable telescopic column is retracted.

In one embodiment, each said two consecutive turns of said structural band that form said retractable telescopic column partly overlap to form an overlapping section, with a portion of said fastening band being wound in a helix adjacent to said overlapping section and with said first and second fastening means engaging each other at said overlapping section to releasably link said each two consecutive turns of said structural band that form said retractable telescopic column.

In one embodiment, said first fastening means comprise longitudinally spaced-apart teeth protruding from said fastening band, and said second fastening means comprise spaced-apart openings longitudinally disposed along said structural band and positioned in said each two consecutive turns of said structural band that form said retractable telescopic column so as to register in said overlapping section by pairs, with at least some of said pairs of openings being each engaged by a corresponding said tooth.

In one embodiment, said guiding and retaining member is a punctual abutment member mounted to said rotor that prevents disengagement of said teeth of said fastening band from the turn of said structural band forming said telescopic column nearest said structural band first portion, with the other turns of said structural band forming said telescopic column being securely engaged by said teeth of said fastening band as long as said turn of said structural band forming said telescopic column nearest said structural band first portion remains engaged by said teeth.

In one embodiment, said guiding and retaining member is a roller.

In one embodiment, said linear actuator further comprises an additional guiding member mounted to said rotor for guiding said second band towards the telescopic column.

In one embodiment, said linear actuator further comprises a first anti-rotation member attached to either one of said structural and fastening bands and engaging a second anti-rotation member attached to said frame, wherein said structural and fastening bands are prevented from rotating.

In one embodiment, said teeth are also first anti-rotation members that cooperate with second anti-rotation members provided on said frame in spaced-apart fashion around said central axis, with at least one of said teeth engaging a corresponding space defined between two said second anti-rotation members at all times, whereby said structural and fastening bands are prevented from rotating.

In one embodiment, said structural band is preformed in an inclined configuration so that each turn defines a slightly conical shape.

In one embodiment, said drive means includes a power driven rotor rotatably mounted to said first frame portion and carrying said guiding and retaining member and said support member, said linear actuator also comprising a structural band magazine movable relative to said rotor and said frame and carrying said structural band first portion.

In one alternate embodiment, said first frame portion carries said guiding and retaining member and a structural band magazine movable relative to said first frame portion and carrying said structural band first portion, with said second frame portion carrying said drive means that includes a power driven rotor fixedly attached to said first end of said fastening and structural bands and rotatably carried by said second frame portion.

DETAILED DESCRIPTION OF THE EMBODIMENTS

Figure 1:
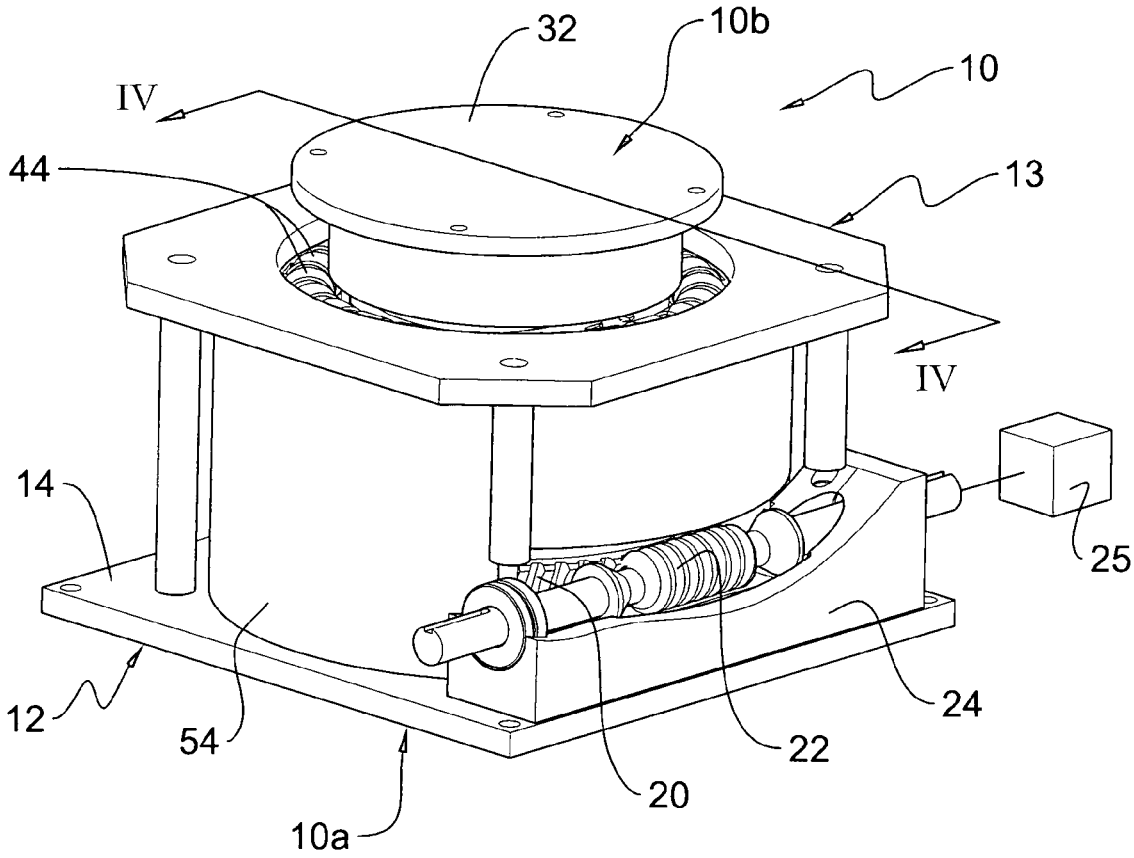
FIG. 1 is a perspective view of a linear actuator according to the present invention in its retracted condition, with the top portion of the drive shaft being partly removed to show the engagement of the drive shaft with the rotor geared flange.
Figure 2:
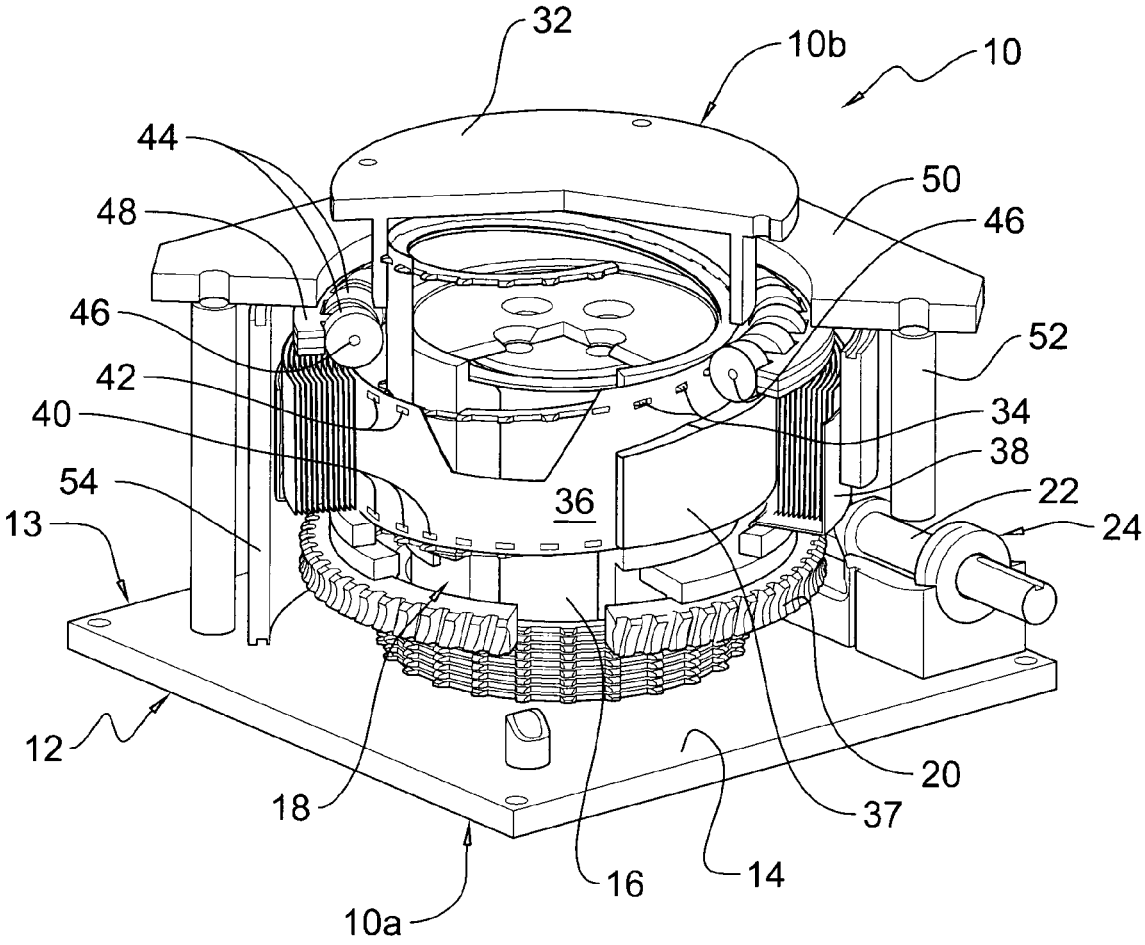
FIG. 2 is a partial perspective view of the linear actuator of FIG. 1, at a different angle, with the peripheral wall, the second band, the rotor, the hub, the ring of idle wheels, the wheel ring, the wheel support plate, the corner posts and the drive shaft casing being partly broken to more clearly show the inner parts of the linear actuator.
Figure 3:
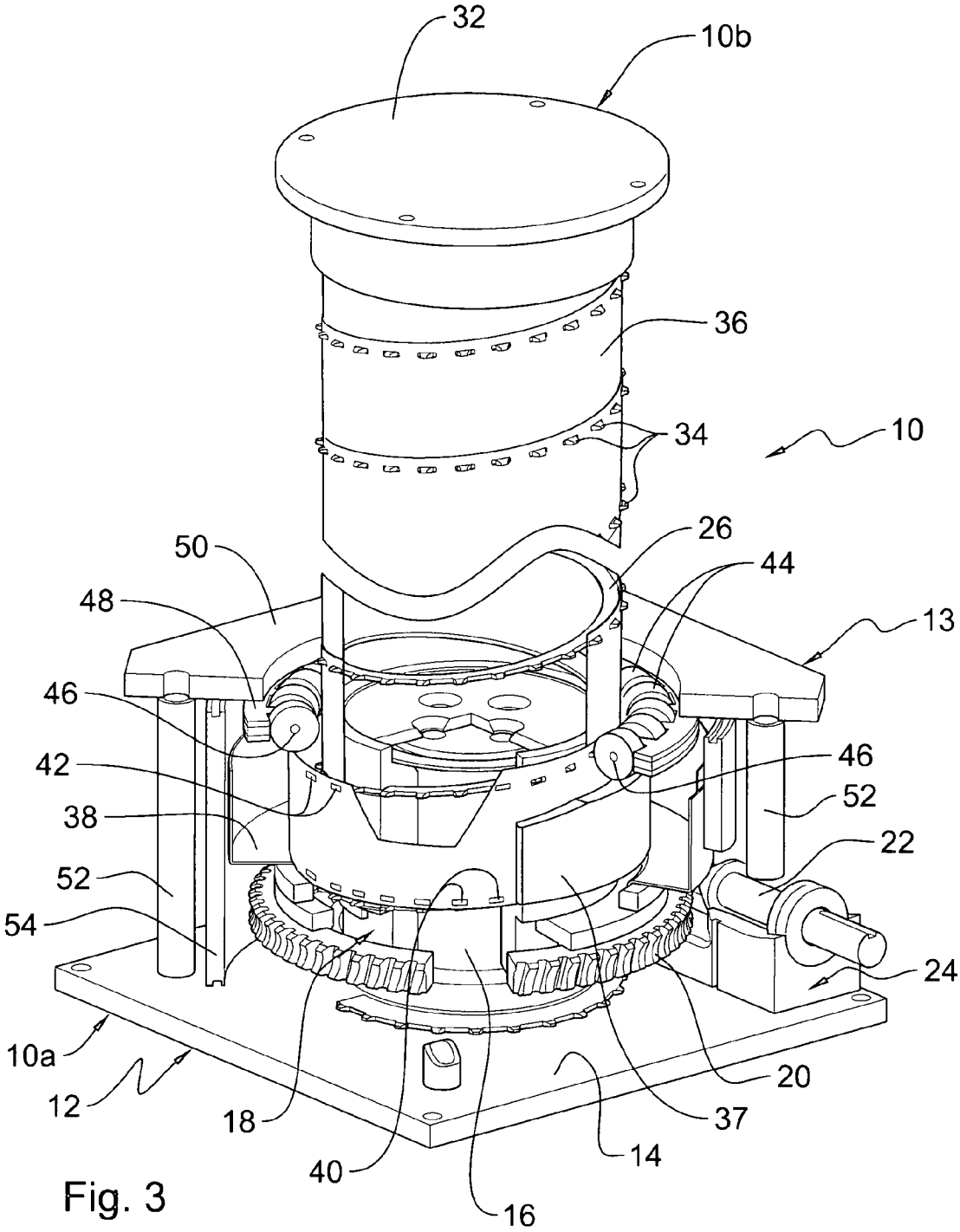
FIG. 3 is a view similar to FIG. 2, but with the linear actuator being in its extracted condition.
Figure 4:
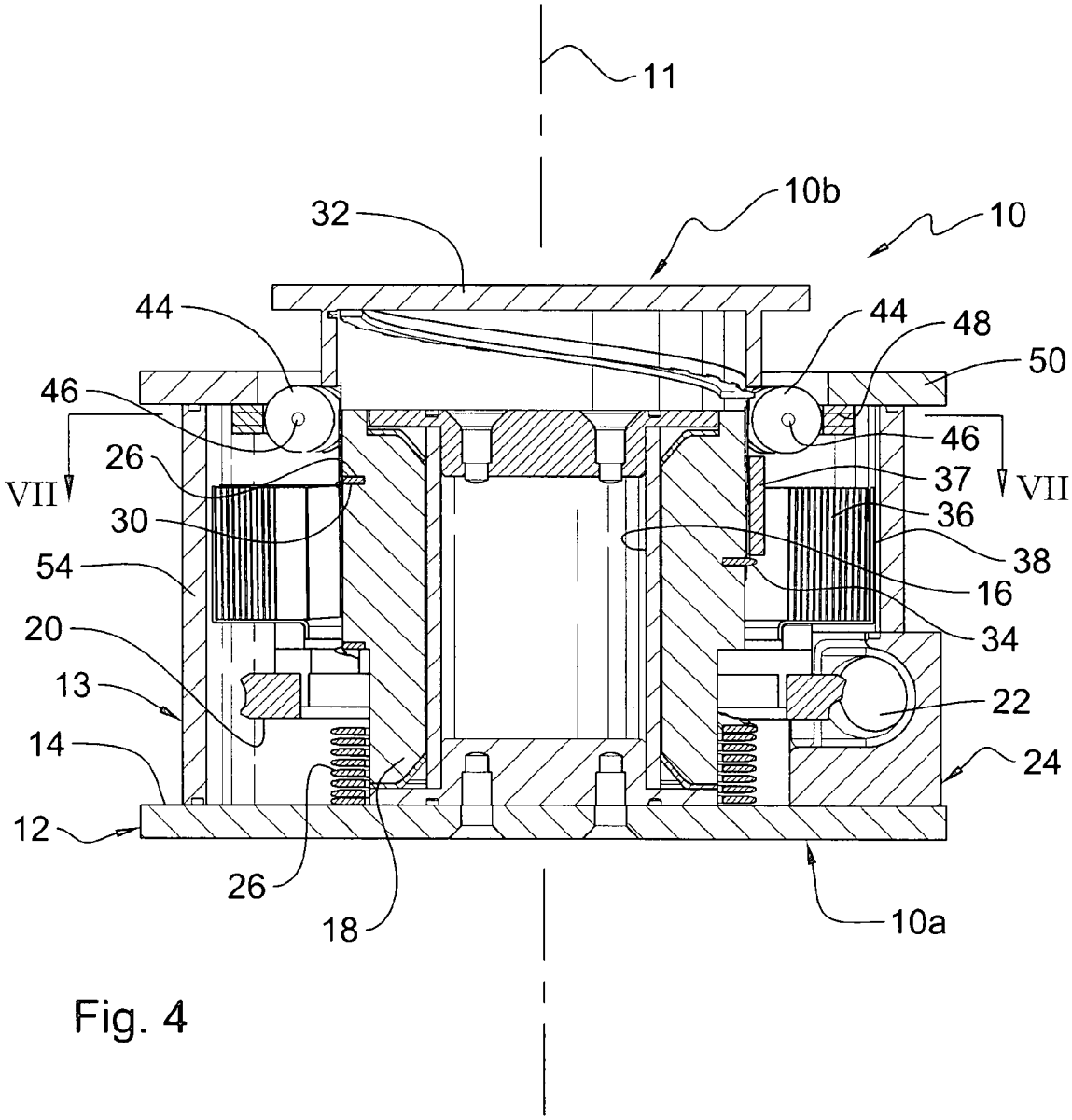
FIG. 4 is a cross-sectional view of the linear actuator taken along line IV—IV of FIG. 1.
Figure 5:
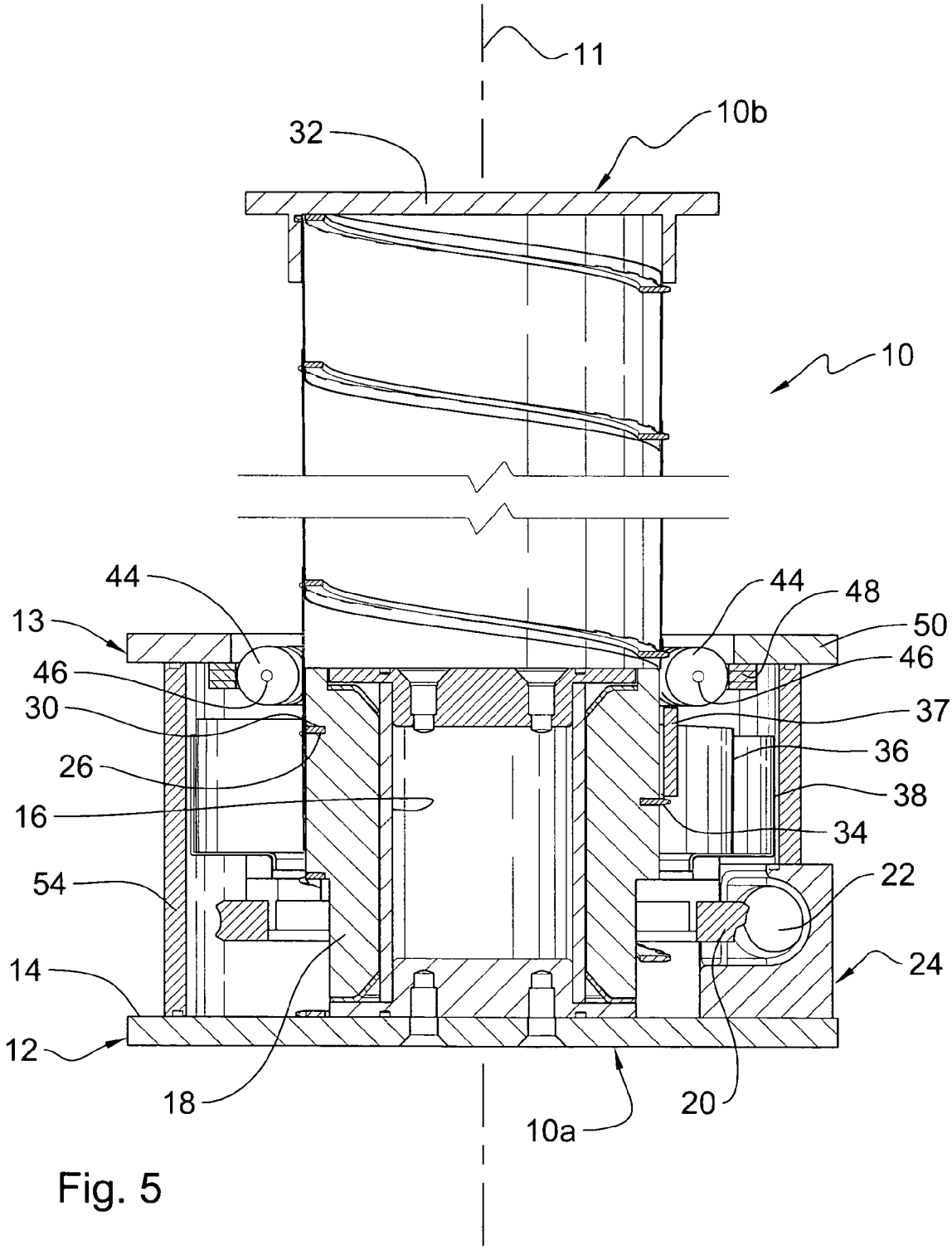
FIG. 5 is a cross-sectional view similar to FIG. 4, but with the linear actuator being in its extracted condition.
Figure 6:
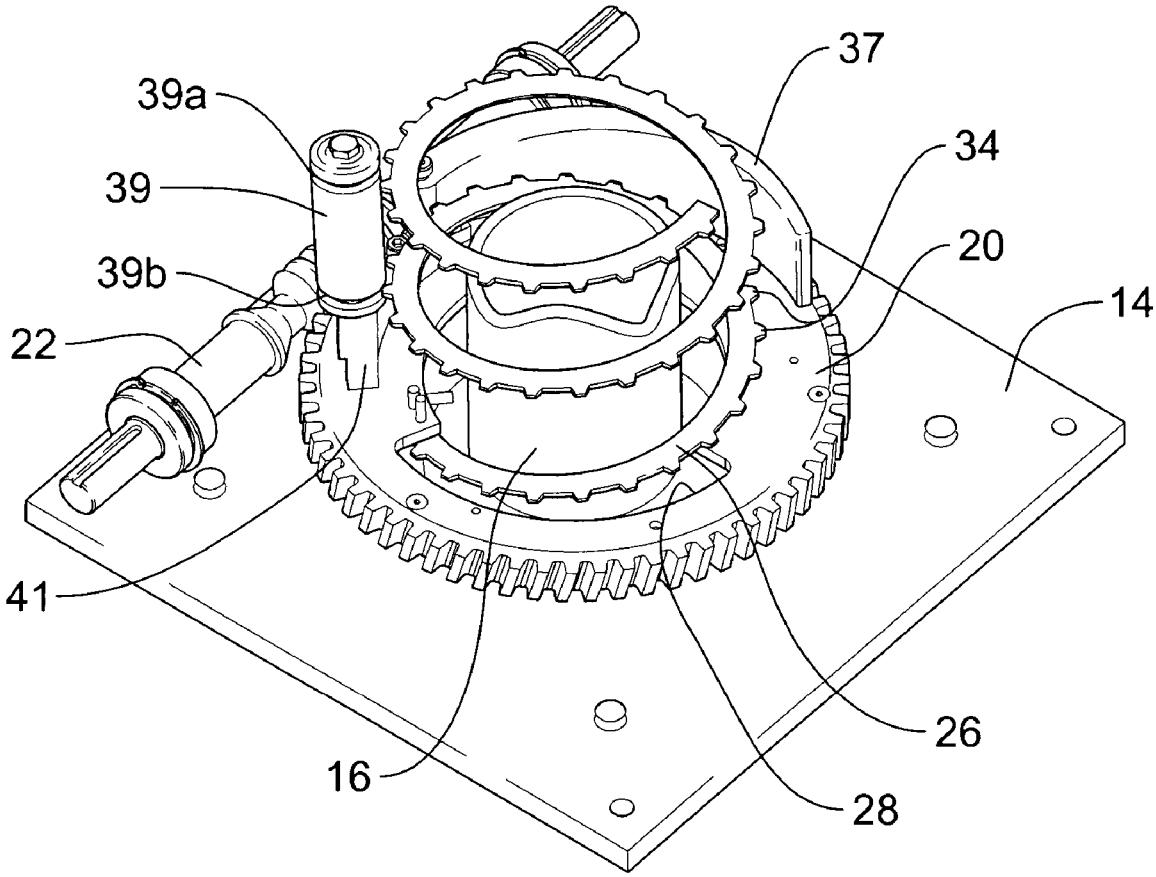
FIG. 6 is a partial perspective view of the linear actuator of FIG. 1, with the peripheral wall, the ring of idle wheels and its support plate, the top load-bearing platform and the second band being removed, with the first band partly shown, with the rotor being removed except for its geared flange portion, and with the central hub being partly broken, for showing particularly the second band guides and the first band opening in the rotor flange.
Figure 7:
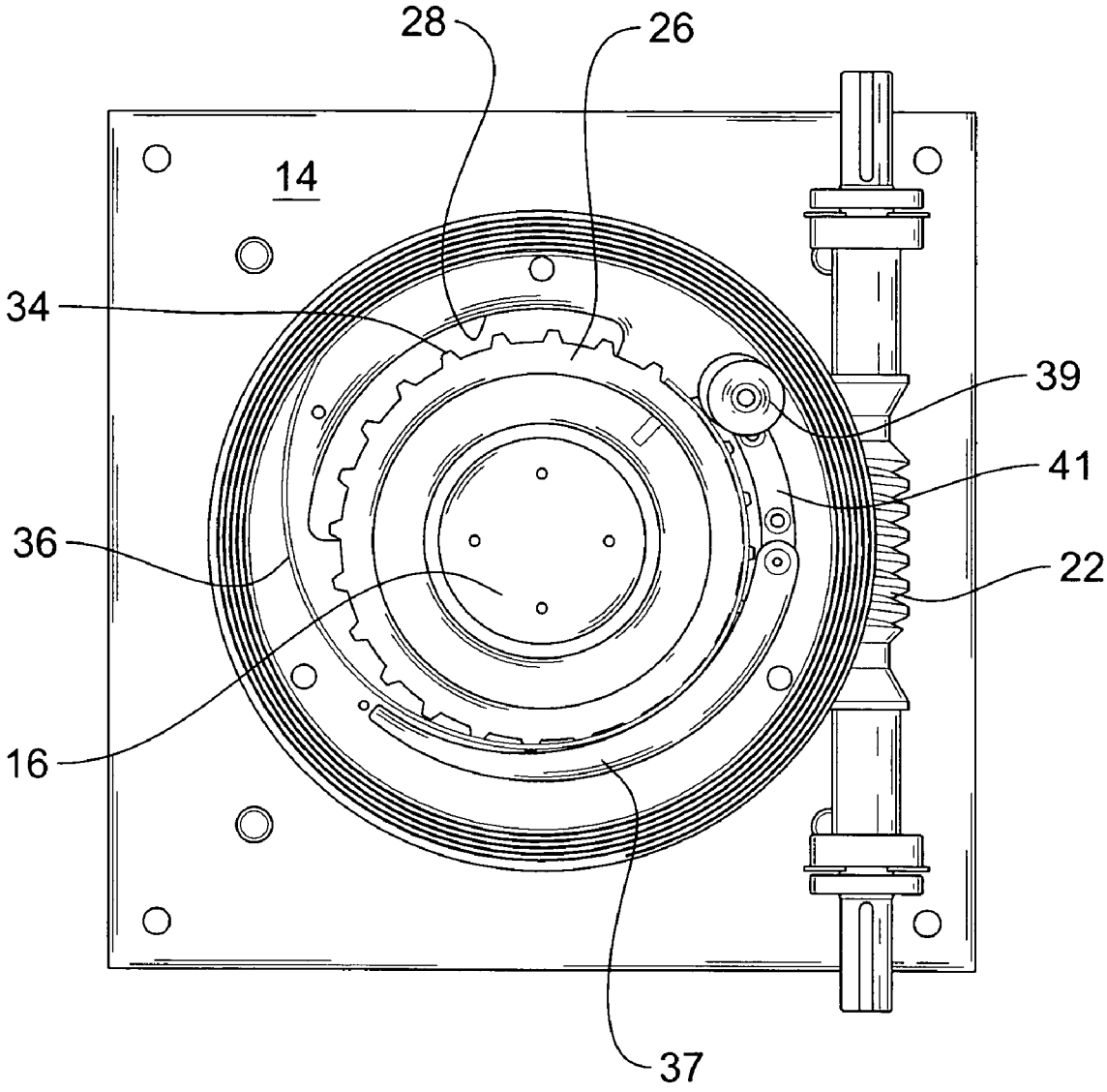
FIG. 7 is a cross-sectional top plan view taken along line VII—VII of FIG. 4 with the rotor being removed.
Figure 8:
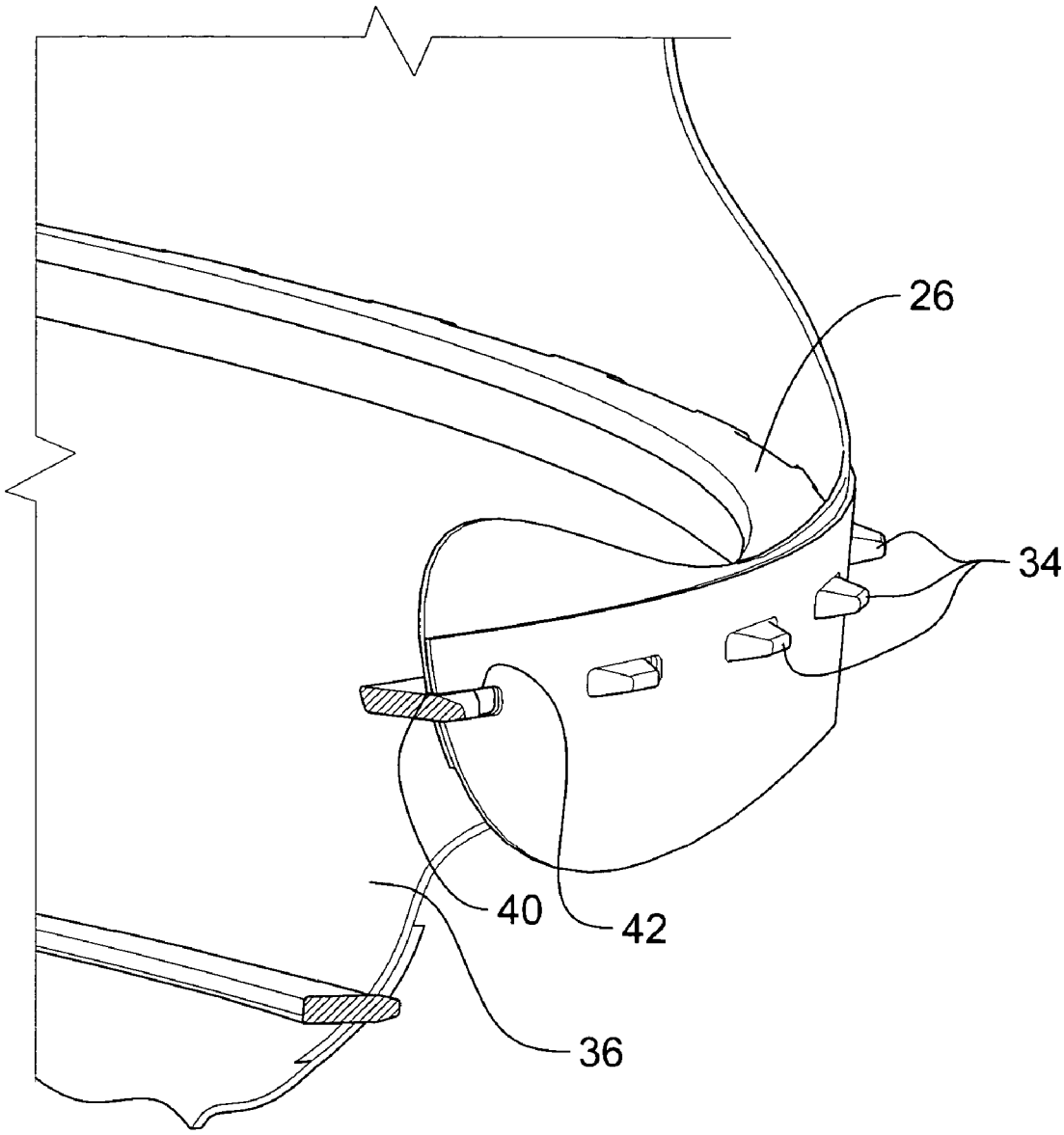
FIG. 8 is an enlarged, partial perspective view of a portion of the intertwined bands forming the retractable telescopic column.

FIGS. 1–8 show a linear actuator 10 according to one embodiment of the present invention, for use in exerting pushing and/or pulling actions on outer elements. One example of an application of the linear actuator 10 of the present invention, to which it is not limited, is for use as a vertical pushing member similarly to the push actuator described in the Gagnon patent discussed in the Background of the Invention section. Other alternate uses of the linear actuator will be described later on.

Linear actuator 10 defines opposite first and second ends 10*a*, 10*b* and an intermediate portion between first and second ends 10*a*, 10*b* wherein its first and second bands are being releasably linked or interconnected to each other, as described hereinafter. Linear actuator 10 further defines a central axis 11 extending between first and second ends 10*a*, 10*b* and comprises a frame 13 including a base 12 formed of a bottom, ground-resting plate 14 and an upstanding cylindrical hub 16 carried by bottom plate 14. The linear actuator also comprises a rotor 18 rotatably carried by base 12 over bottom plate 14 and around hub 16. Rotor 18 includes a radially outwardly extending peripheral flange 20 which is provided with gear teeth on its outer periphery. Geared flange 20 is operatively coupled to a threaded drive shaft 22 which is intended to be operatively coupled to a suitable power source 25 (schematically shown in FIG. 1) such as a motor or the like. A drive shaft casing 24 is provided over shaft 22.

Linear actuator 10 also comprises a first elongated fastening band 26 wound in helical configuration about the actuator central axis 11 and capable of taking a retracted stacked position, and an extended position with its turns spaced from one another in the direction of the central axis 11. First band 26 is more particularly stacked between the linear actuator intermediate portion and the linear actuator first end 10*a*, with the stack of turns of the first band 26 resting on base 12 around rotor 18 and frame hub 16. The helical first band 26 has a first end near the actuator first end 10*a* which may be attached thereto, and extends through an opening 28 in the geared flange 20 of rotor 18 (see FIGS. 6 and 7) upwardly into a helical groove 30 made in the outer periphery of rotor 18 above its geared flange 20. First band 26 further extends upwardly beyond rotor 18, and it has a second end attached to the lower surface of a load-bearing platform 32. The elongated first band 26 is generally flat and comprises a number of longitudinally disposed releasable fasteners in the form of longitudinally spaced-apart teeth 34 protruding from its outer edge. When it engages helical groove 30, first band 26 is entirely embedded therein except for teeth 34 that protrude outside of groove 30, and first band 26 can freely slide within groove 30.

Linear actuator 10 also comprises a second elongated flat structural band 36 which is vertically disposed and wound on itself, with its turns transversely parallel to the actuator central axis 11. Second band 36 is capable of taking a retracted spiral position with its turns nested within one another, and an extended position with its turns forming a helix around the actuator central axis 11 and generally equally radially spaced therefrom to form a retractable telescopic column having a substantially cylindrical wall. More particularly, second band 36 has a first end located within a second band magazine 38 which is slidably carried by rotor 18. The first end of second band 36 may be attached to second band magazine 38. The portion of second band 36 which is located between the intermediate portion of linear actuator 10 and its first end 10*a* is stored in magazine 38, distinctly of first band 26, with its turns nested within one another. Second band 36 is guided between magazine 38 and the telescopic column being formed by a spring-loaded pivotable guide arm 37 (see FIGS. 6 and 7) pivotally mounted to a guide support block 41 attached to the radially extending flange 20 of rotor 18 at the linear actuator intermediate portion, and by a retaining member in the form of a retaining roller 39 upstanding from and rollably attached to guide support block 41 at the linear actuator intermediate portion. Retaining roller 39 is formed with upper and lower peripheral grooves 39*a*, 39*b* that allow the protruding teeth 34 of first band 26 to slide therein, as detailed hereinafter. The second end of second band 36 is attached to the lower surface of load-bearing platform 32. The portion of second band 36 forming the telescopic column is located between the intermediate portion and the second end 10*b* of linear actuator 10. Second band 36 comprises a number of longitudinally disposed spaced-apart lower and upper openings 40, 42 made spacedly adjacent to each edge of the elongated second band 36.

To form a retractable telescopic vertical column, rotor 18 is rotated in a first direction by means drive shaft 22. Upon this rotation being imparted to rotor 18, first and second bands 26, 36 will both be guided to gradually form the column as described hereinafter.

As rotor 18 rotates in its first direction, the helical groove 30 made in the outer periphery of rotor 18 above geared flange 20 will guide first band 26 upwardly, with first band 26 slidingly engaging helical groove 30 in the intermediate portion of linear actuator 10. This will result in first band 26 being raised vertically along the actuator central axis 11, although without any rotation being imparted to first band 26, while the turns of first band 26 are gradually and successively spaced from one another.

Simultaneously, second band 36 will be engaged by guide arm 37 and by retaining roller 39, which rotate integrally with rotor 18, in the intermediate portion of actuator 10, to successively guide each turn of second band 36 located within second band magazine 38 radially inwardly. Each turn of second band 36 will thus be guided so that its upper edge portion is applied against and overlaps the lower edge portion of the preceding turn of second band 36. Furthermore, the overlapping section of each two consecutive turns of second band 36 forming the column will further be interconnected through the instrumentality of one turn of first band 26. More particularly, each turn of second band 36 forming the telescopic column will have its upper openings 42 registering with the lower openings 40 of the preceding turn of second band 36 in the overlapping section, and each pair of registering lower and upper openings 40, 42 is engaged by a corresponding tooth 34 of first band 26. The first band 26 is suitably spaced to allow this releasable interconnection between first and second bands 26, 36 by setting the appropriate pitch in the helical groove 30 formed in rotor 18.

Also, retaining roller 39 will ensure by its position that the turns of second band 36 are applied and maintained against the turns of first band 26 with first band teeth 34 engaging the registering pairs of second band openings 40, 42. Indeed, retaining roller 39 is located very near first band 26, being spaced therefrom approximately of the thickness of second band 36 or very slightly more, with the teeth 34 of first band 26 sliding through the peripheral grooves 39*a*, 39*b* of retaining roller 39 to allow retaining roller 39 to engage second band 36 all along its width, including beyond the two rows of teeth 34 that project near retaining roller 39. Since second band 36 extends between retaining roller 39 and first band 26, second band 36 will be positively guided against first band 26 and first band teeth 34 will be forced into second band openings 40, 42 when rotor 18 rotates. Furthermore, the portion of second band 36 forming the telescopic column will be prevented by retaining roller 39 from accidental release from first band 26 to prevent the column from collapsing. Indeed, by maintaining a generally punctual pressure, relative to the entire length of second band 36, against second band 36 with retaining roller 39 at the lowermost portion of the telescopic column being formed to ensure that second band 36 remain engaged by the teeth 34 of first band 26, second band 36 will be prevented from disengagement from teeth 34 of first band 26 throughout the telescopic column being formed. Thus, retaining roller 39 is a punctual abutment member that prevents second band 36 from gradually unwinding and resulting in the telescopic column collapsing. It is understood that retaining roller 39 could be replaced by any suitable retaining member which prevents second band 36 from disengagement from teeth 34, including other punctual abutment members such as a low-friction block punctually forcing second band to be engaged by teeth 34 by being positioned close to first band 26, or other retaining members such as hooks or the like elements provided on each tooth 34.

In summary, retaining roller 39 acts as a guiding and retaining member that thus has more than one purpose: it guides each turn of second band 36 being incorporated into the telescopic column into a proper alignment for engagement with first band 26 and with the preceding turn of second band 36, it ensures that teeth 34 of first band 26 engage the second band openings 40, 42, and it also retains second band 36 to prevent the telescopic column from collapsing.

Guide arm 37 has the purpose of generally guiding second band 36 between second band magazine 38 and the telescopic column being formed, but linear actuator 10 could theoretically be used without guide arm 37 since retaining roller 39 also plays the role of a guiding member in linear actuator 10 since it guides each turn of second band 36 to position it properly against first band 26 and against the preceding turn of second band 36 when the telescopic column is being formed. The purpose of guide arm 37 is mostly to help guide second band 36 when there are sudden changes of the speed of rotation of rotor 18. In such situations, the inertia of the second band magazine, possibly loaded with one or more turns of second band 36, may carry second band magazine 38 in rotation at a faster or slower speed than necessary relative to the telescopic column, and it is then desirable to have spring-loaded guide arm 37 dampen the movement of second band 36 and help calibrate the speed of rotation of magazine 38 in addition to the natural intrinsic elasticity of second band 36.

Second band 36 will consequently form the substantially cylindrical structural wall of the telescopic column being formed, while first band 26 will act to releasably interconnect each two consecutive turns forming the column to prevent. Each turn of second band 36 forming the column will be raised as the column is formed, although these turns of second band 36 forming the column are not imparted with any rotation whatsoever. Consequently, the telescopic column being formed does not rotate as it is raised as explained hereinabove.

The load of the telescopic column formed by the interconnected first and second bands 26, 36 is supported by the engagement of first band 26 within the helical groove 30 formed in rotor 18. In other words, the entire load pushed or pulled by load-bearing platform 32 is transmitted through bands 26, 36 to the portion of first band 26 which engages groove 30, and is supported by the latter.

For retracting the telescopic column, rotor 18 is rotated in the opposite direction by means of power source 25 acting on drive shaft 22. By doing so, the lowermost turn of second band 36 which forms the column is disassembled from the column and is guided by retaining roller 39 and guide arm 37 radially outwardly back into the second band magazine 38. Simultaneously, the first band 26 is gradually lowered through helical groove 30 into its ground-resting stacked position.

Second band 36 is stored in magazine 38 which is slidable relative to rotor 18 on which it is mounted, to allow rotation of magazine 38 relative to rotor 18 during extraction or retraction of the telescopic column. Indeed, since the portion of second band 36 which forms the telescopic column does not rotate, magazine 38 rotates relative to rotor 18 to allow the second band 36 to remain properly positioned relative to the telescopic column. This rotation of magazine 38 will be imparted by the intrinsic elastic bending resistance of the second band 36 itself when rotor 18 is rotated and as second band 36 is fed into or from the telescopic column. It is noted that second band magazine 38 will not remain stationary in rotation relative to base 12 even though the portion of vertical band 36 which forms the vertical column will remain stationary in rotation. Indeed, since the diameter of one turn of second band 36 is greater in second band magazine 38 than in the telescopic column, absolute rotation of second band magazine 38 together with the portion of second band 36 stored therein relative to base 12 will occur as a result to compensate this diameter difference.

It is noted that the portion of second band 36 forming the telescopic column will have its turns slightly inclined, i.e. defining a slight conical shape, due to their overlapping relationship. Indeed, each turn abuts directly against first band 26 at its edge closest to the actuator first end 10*a*, while it is spaced from first band 26 by the underlying edge portion of the adjacent turn it overlaps at its edge closest to the actuator second end 10*b*. Consequently, in one embodiment, second band 36 is preformed with a slight inclination corresponding to the inclination it will have when forming the telescopic column to reduce stresses in second band 36. Generally, it is understood that in the present specification, the shape of the telescopic column may be referred to as being cylindrical or substantially cylindrical, and that this cylindrical or substantially cylindrical shape will include an inclination of each turn of the second band due to overlapping sections in the telescopic column. Also, it is understood that second band 36 will be said to have its turns parallel or substantially parallel to the central axis 11 of linear actuator 10, and that this parallel or substantially parallel relationship is considered to include the fact that the turns of second band 36 may in fact be slightly inclined or conical as described hereinabove.

The engagement of the first band teeth 34 within registering top and bottom edge openings 42, 40 of the consecutive turns of second band 36 allows the load from two consecutive turns of second band 36 to be transmitted from one to the other through first band 26. In addition to allowing such a load transfer, first band teeth 34 also allow a secure interconnection between each two consecutive turns of second band 36, which helps to prevent the telescopic column from collapsing if a force having a radial vectorial component is applied against the telescopic column. Indeed, with prior art push actuator devices wherein the turns of the vertical band simply rest on the turns of the horizontal band, such transversely applied forces may accidentally disengage the vertical turns from their underlying horizontal turns, resulting in the column collapsing. However, with the first band teeth 34 of the present invention engaging the corresponding pairs of registering top and bottom openings 42, 40 in successive partly overlapping turns of the second band 36, relative axial movement of successive turns of the second band 36 is prevented, which results in each turn of the second band 36 forming the telescopic column being interlocked with the top and bottom adjacent turns of the second band 36 to prevent accidental unwinding of the turns of the second band 36 from the column, and which consequently prevents the column from collapsing. Since the lowermost turn of second band 36 forming the telescopic column is prevented from unwinding due to its abutment against retaining roller 39, the entire portion of second band 36 forming the telescopic column will remain structurally stable and the telescopic column will be able to axially transfer important loads.

The first band teeth 34 engaging the second band openings 40, 42 also allow the column of the present invention to be used without the load-bearing platform 32 actually being attached to a fixed outside element, such as a load being lifted. Indeed, with the prior art push actuator, if the load-bearing platform was not attached to an outside element, power-rotating the rotor resulted in the horizontal and vertical bands also undesirably rotating, with the consequence that the load-bearing platform would also rotate. With the linear actuator of the present invention, however, the first band teeth 34 that protrude beyond the substantially cylindrical outer wall surface of the telescopic column formed of successive helical turns of the second band 36, are used as first anti-rotation members that cooperate with second complementary anti-rotation members provided on the fixed linear actuator frame 13. Indeed, as the column is extracted or retracted, teeth 34 slide within spaces defined between idle wheels 44 that are rotatably mounted to shafts 46 supported by a support ring 48 attached to a wheel support plate 50 fixedly carried spacedly over base 12 by means of posts 52. These idle wheels 44, that form the second anti-rotation members, prevent teeth 34 from rotating in one direction or another due to the tangential abutment of teeth 34 against a corresponding wheel 44, while allowing teeth 34 to freely move in the direction of the actuator central axis 11. This is allowed due to the fact that teeth 34 are all aligned in the direction of central axis 11 with corresponding openings between idle wheels 44. It is understood that as the telescopic column is extracted or retracted, the consecutive turns of first band 26 will gradually be lifted to or lowered from the telescopic column and some teeth 34 of first band 26 will engage spaces between idle wheels 44 at all times. Consequently, even if load-bearing platform 32 is not attached to an outside element, the telescopic column will be prevented from rotation.

A peripheral wall 54 is installed about the lower portion of the linear actuator, between base plate 14 and wheel support plate 50. In one embodiment, the whole area within peripheral wall 54 is filled with lubricant such as oil to ensure low-friction sliding engagements of the different elements that slide against one another in linear actuator 10.

In one embodiment of the invention, linear actuator 10 is used not only as a pushing or lifting device, but may also be used as a pulling device. Indeed, due to the integral interconnection of the successive turns of second band 36 that form the column resulting from the releasable engagement of fastening teeth 34 that engage top and bottom openings 42, 40 in overlapping sections of the second band 36, linear actuator 10 may be used to pull a load attached to load-bearing platform 32 towards base 12.

Furthermore, linear actuator 10 could be used with its central axis 11 being horizontal or inclined. Thus, generally, linear actuator may be used to push or pull a load along its central axis, with the axis being horizontal, vertical or inclined. This versatility in the orientation of the linear actuator central axis 11 is brought about by the interlock between the consecutive turns of second band 36 by means of the first band 26 which is provided with fasteners in the form of teeth 34 that engage the registering top and bottom openings 42, 40 in the overlapping sections of second band 36. Indeed, this interlock allows a load, including the telescopic column's own weight, to be moved along the actuator central axis notwithstanding its orientation with this load not resulting in the telescopic column collapsing due to the fact that the consecutive turns of the second band 36 forming the telescopic column are attached to one another.

Generally, the base 12 and the platform 32 can be said to both be part of the push actuator frame 13, with the first frame portion (base 12) being movable relative to the second base portion (platform 32) as the telescopic column formed of first and second bands 26, 36 is extracted and retracted.

It is understood that the helical groove 30 in rotor 18 will form a portion of a helix. In one embodiment, it will preferably form at least one full turn of a helix. Also, alternate support members could be used to support the first band 26 and consequently support the load of the linear actuator 10, including for example a series of spaced-apart or adjacent rollers forming at least a portion of a helix, or a series of balls supported on a track forming at least a portion of a helix.

Also, it could be envisioned to alternately have the second structural band supported by a suitable support member, the sole purpose of the first fastening band then being to releasably fasten the consecutive turns of the second band that form the telescopic column. In a linear actuator where the second structural band is supported directly by the support member, the entire load to be displaced or supported by the telescopic column would be transferred to the linear actuator rotor through the lowermost second band turn forming the telescopic column.

Consequently, the support member carried by rotor 18 will form at least a portion of a helix for supporting part of either the first band 26 or the second band 36 and will successively space the turns of the band thus supported, to allow an axially oriented load applied on linear actuator 10 to be transmitted from the band it supports directly to rotor 18 while allowing a rotation of rotor 18 relative to this supported band.

Although the embodiment of the invention shown in the drawings includes a second band 36 located outwardly of the rotor 18 in the second band magazine 38, it is envisioned in an alternate embodiment that the second band be provided inside a hollow rotor within a second band magazine also located inside the rotor, and with the first band extending through a helical groove made on the inner surface of the hollow rotor. The second band would then be wound on itself in a spiral pattern within the rotor, with the spiral turns having a lesser diameter than that of the telescopic column being formed.

The second band could also be configured differently. In the embodiment shown in the drawings, second band 36 will preferably be preformed with in an inclined configuration to conform to the position it will take in the telescopic column, as in indicated hereinbelow, but it could for example instead be formed for example of two flat sections joined at an intermediate cross-sectionally elbowed section linking the two flat sections. Generally, it can be said that the second band is substantially flat, but it is understood that it may in fact include cross-sectionally elbowed portions, reinforcement ribs, or other such relief.

It is envisioned to use alternate fastening means to releasably fasten the first and second bands 26, 36 to each other in the telescopic column. Generally, it is understood that the first band comprises first fastening means that cooperate with second fastening means provided on the second band to releasably link or interlock the first and second bands. For example, the second band could be provided with fasteners such as teeth while the first band would be provided with openings to be engaged by the second band teeth. Alternately, other types of fasteners could be used altogether, such as hook-type fasteners (the first fastening means) provided on the first band that would attach themselves to the upper edge (the second fastening means) of the second band. It is also envisioned that each two consecutive turns of the second band forming the column not include any overlapping sections but rather be positioned in close proximity without overlap, with the first band still linking the consecutive turns of the second band forming the column. Generally, it can be said that the consecutive turns of the second band forming the column are positioned into successive adjacent helical configuration, with this adjacent configuration including overlap or not, and including direct contact or proximity without direct contact.

Figure 9:
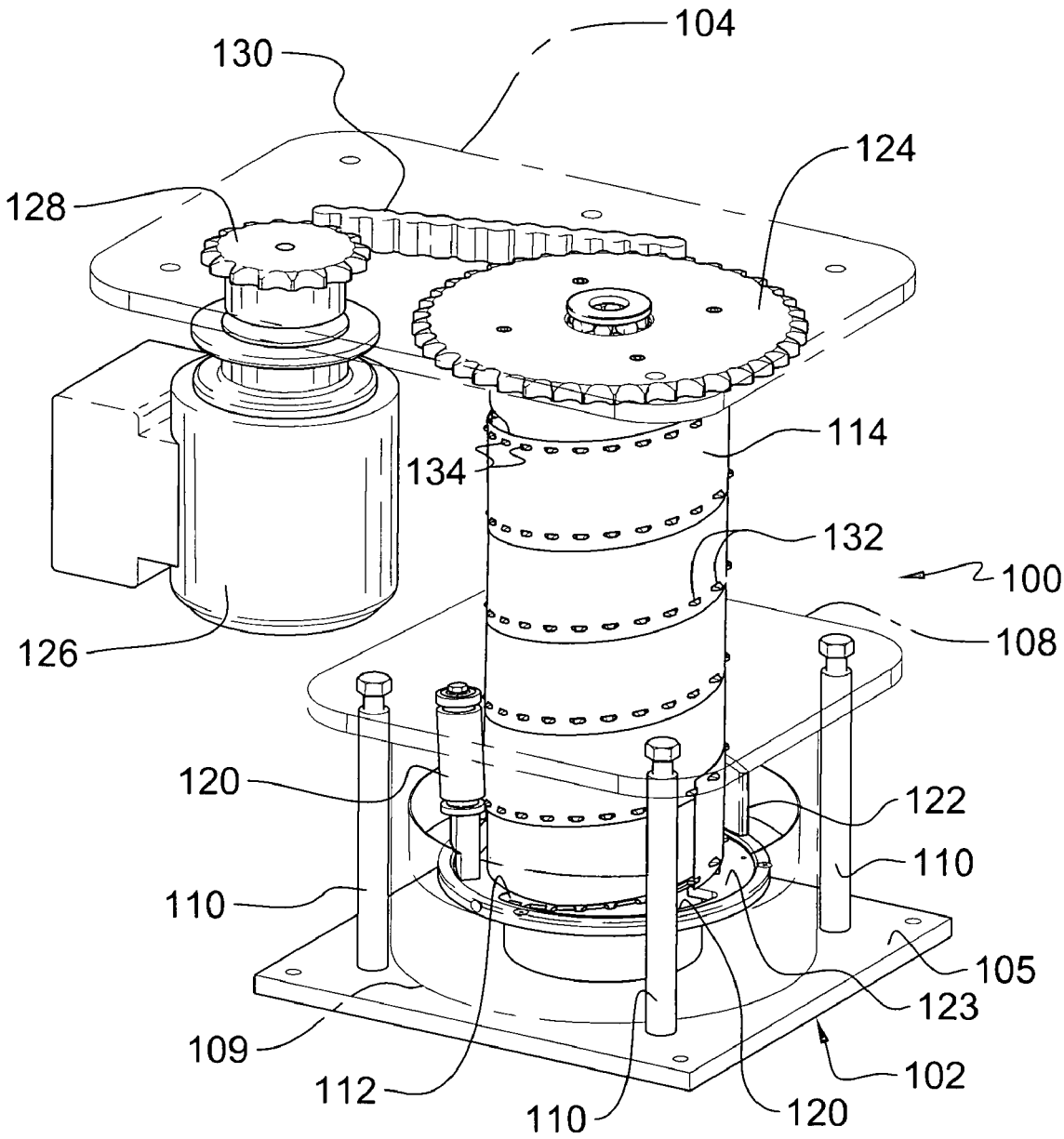
FIG. 9 is a partial perspective view of a linear actuator according to another embodiment of the invention.
Figure 9A:
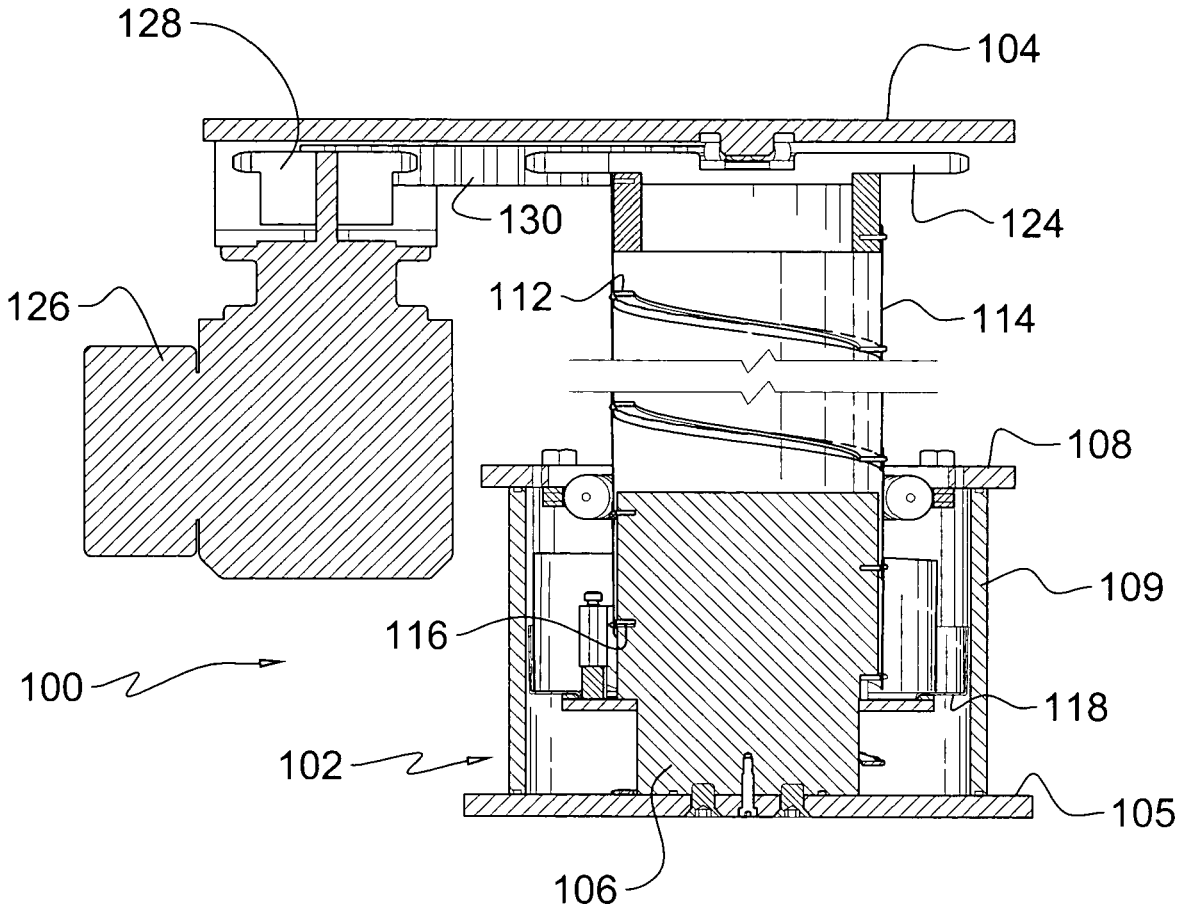
FIG. 9A is a cross-sectional view of the linear actuator of FIG. 9A.

Another alternate embodiment of the invention is shown in FIGS. 9 and 9A, where the linear actuator 100 is similar to the linear actuator 10 of the first embodiment, except as noted hereinbelow.

Linear actuator 100 comprises opposite first and second frame portions 102, 104 for attachment to respective outside elements (not shown) to be pulled towards one another or drawn apart by means of linear actuator 100. First frame portion 102 comprises a base 105 to which is fixedly mounted a hub 106, and an intermediate plate 108 is attached spacedly to first frame portion by means of a few posts 110. An optional outer peripheral wall 109 is provided to form a lubricant enclosure which may be filled with lubricant. No anti-rotation devices, such as the idle wheels as in the first embodiment, are provided in this alternate embodiment. The telescopic column is formed by releasably interconnected first and second bands 112, 114 similar to the ones of the first embodiment.

According to the alternate embodiment of the invention shown in FIGS. 9 and 9A, there is no rotor member carried by the first frame portion. Instead, the first toothed band 112 engages a support member in the form of a helical groove 116 made directly into the outer surface of the first frame hub 106. The first extremity of second band 114 is stored in a second band magazine 118 movably carried by hub 106, and second band 114 is guided towards the telescopic column being formed by means of a retaining roller 102 and by an optional spring-loaded guide arm 122, both also carried by hub 106. The first extremity of first band 112 is stored above base plate 105, with first band 112 extending through an opening 120 made in a peripheral flange 123 integrally radially projecting from hub 106.

The respective second extremities of the first and second bands 112, 114 are fixed underneath a rotor platform 124 which replaces the load-bearing platform of the first embodiment, and which is toothed to be coupled to the drive shaft 128 of a motor 126 by means of a chain 130. Motor 126 is fixedly attached to second frame portion 104, and rotor 124 is rotatably mounted to second frame portion 104.

According to this alternate embodiment of the invention, the telescopic column will be extracted or retracted upon the motor 126 rotating the rotor 124. Indeed, rotating rotor 124 in a first direction to extract the telescopic column will cause simultaneous rotation of both the first and second bands 112, 114 in this first direction since they are integrally attached to the rotor 124. This will result in relative rotation of first band 112 and hub 106 permitted by the sliding engagement of first band 112 within helical groove 116. This relative rotation of first band 112 and hub 106 will cause the consecutive turns of first band 112 stored atop base plate 105 to be spaced apart and to be gradually carried towards the second frame portion 104.

Simultaneously, the rotation of second band 114 will cause the consecutive turns of second band 114 to engage the guide arm 122 and the guiding and retaining roller 120 to be guided towards corresponding spaced-apart turns of the first band 112, about the upper portion of hub 106, where the second band holes 132 will engage the protruding first band teeth 134. Thus, in a similar manner than in the first embodiment of the invention shown in FIGS. 1-8, each two consecutive helical turns of second band 114 will be releasably interconnected by one helical turn of the first band 112, to gradually form a telescopic column. The second band 114 will form the outer peripheral wall of the telescopic column, having a substantially cylindrical wall, and the first band 112 will link each two consecutive turns of the second band 114.

Consequently, it can be seen that the support members or helical grooves 30, 116 that allow the consecutive turns of the first bands 26, 112 to be spaced represent spacer means for the first bands 26, 112. These spacer means could have any other suitable alternative configuration, including for example spaced-apart rollers arranged in a helical configuration, or a multiple ball helical track. Generally, the telescopic column will be formed if relative rotation of the spacer means or support member relative to the first and second bands is imparted within the linear actuator. Thus, the drive means can engage any suitable component of the linear actuator 10, 100, including a rotor 18 carrying the spacer means such as in the first embodiment of the linear actuator 10, a rotor 124 attached to the second extremity of the first and second bands as in the alternate embodiment of the linear actuator 100, the first or second bands themselves, or any other component capable of imparting a relative rotation on one hand of the first and second bands, and on the other hand of the spacer means that will space the consecutive turns of the first band. It is understood that the drive means of linear actuators 10, 100 has been shown as including a drive shaft coupled to the geared flange of the rotor and operatively linked to a power source such as a motor, but it is understood that this drive means could include any suitable alternate drive means such as, although not limited to, a motor being directly linked to the linear actuator rotor, a powered rotor engaging the first band teeth, or any suitable drive means by which relative rotation on one hand of the first and second bands and on the other hand of the spacer means or support member is achieved.

Any further modification, which does not deviate from the scope of the present invention, is considered to be included therein, as will be obvious for someone skilled in the art of the present invention in view of the appended claims.

I claim:

1. A linear actuator comprising:

an elongated first band wound in helical form about a central axis and capable of taking a retracted position and an extended position with its turns spaced from one another in the direction of said central axis;

first fastening means carried by said first band and longitudinally disposed therealong;

an elongated second substantially flat band wound on itself, with its turns substantially transversely parallel to said central axis, and capable of taking a retracted, spiral position with its turns nested within one another and an extended position with its turns forming a helix around said central axis and generally equally radially spaced therefrom to form a telescopic column, said first and second bands, when in retracted position, in respective locations so as to clear each other;

second fastening means carried by said second band and longitudinally disposed therealong, said second fastening means capable of cooperating with said first fastening means to releasably interlock said first and second bands;

spacer means to successively space the turns of said first band;

drive means to cause relative rotation on one hand of said first and second bands and on the other hand of said spacer means about said central axis;

guide means to guide the turns of said second band towards the turns of said first band to releasably interlock said first and second fastening means; and retaining means retaining said first and second fastening means in interlocked fashion in said telescopic column.

2. A linear actuator as defined in claim 1, wherein each said two consecutive turns of said second band that form said retractable telescopic column partly overlap to form an overlapping section, with a portion of said first band being wound in a helix adjacent to said overlapping section and with said first and second fastening means engaging each other at said overlapping section to releasably link said each two consecutive turns of said second band that form said retractable telescopic column.

3. A linear actuator as defined in claim 2, wherein said first fastening means comprise longitudinally spaced-apart teeth protruding from said first band, and said second fastening means comprise openings longitudinally disposed along said second band and positioned in said each two consecutive turns of said second band that form said retractable telescopic column so as to register in said overlapping section by pairs, with at least some of said pairs of openings being engaged by corresponding said teeth.

4. A linear actuator as defined in claim 3, wherein said retaining member and said guiding member are a roller mounted to said rotor.

5. A linear actuator as defined in claim 2, wherein said second band is preformed in an inclined configuration so that each turn defines a slightly conical shape.

6. A linear actuator as defined in claim 1, further comprising a first anti-rotation member attached to either one of said structural and first bands and engaging a second anti-rotation member attached to said frame, wherein said structural and first bands are prevented from rotating.

7. A linear actuator as defined in claim 3, wherein said teeth are also first anti-rotation members that cooperate with second anti-rotation members provided on said frame in spaced-apart fashion around said central axis, with at least one of said teeth engaging a corresponding space defined between two said second anti-rotation members at all times, wherein said structural and first bands are prevented from rotating while they are moved between their extended and retracted positions.

8. A linear actuator as defined in claim 1, wherein said drive means includes a power driven rotor rotatably mounted to a first frame portion, said rotor carrying said guide means, said retaining means and said spacer means, said linear actuator also comprising a second band magazine movable relative to said rotor and said frame and carrying the portion of said second band which is in said retracted, spiral position with its turns nested within one another, said first and second elongated bands having a first end located near said first frame portion and a second end attached to a second frame portion.

9. A linear actuator as defined in claim 8, wherein said spacer means includes a support member having a helical configuration, carried by said rotor and engaged by a portion of said first band.

10. A linear actuator as defined in claim 9, wherein said support member is a helical groove.

11. A linear actuator as defined in claim 1, further comprising:

a first frame portion carrying said spacer means, said guide means, said retaining means and a second band magazine movable relative to said first frame portion and carrying the portion of said second band which is in said retracted, spiral position with its turns nested within one another; and a second frame portion, with said drive means including a power driven rotor fixedly attached to a first end of said first and second bands and rotatably carried by said second frame portion.

12. A linear actuator as defined in claim 11, wherein said spacer means includes a support member having a helical configuration, carried by said first frame portion and engaged by a portion of said first band.

13. A linear actuator as defined in claim 9, wherein said support member is a helical groove made in said first frame portion.

14. An elongated linear actuator having opposite first and second ends and an intermediate portion between said first and second ends, said linear actuator further defining a central axis extending between said first and second ends and comprising:

a frame comprising a first frame portion at said first end and a second frame portion at said second end movable relative to said first frame portion between retracted and extracted positions, with said second frame portion being closer to said first frame portion in said retracted position than in said extracted position;

a rotor member rotatably carried by said first frame portion and rotatable about said central axis;

drive means, capable of selectively rotating said rotor member relative to said first frame portion;

a first elongated band wound according to a helical pattern about said central axis, having a first end portion adjacent to said linear actuator first end and a second end portion attached to said second frame portion, and comprising longitudinally disposed releasable fasteners;

a second elongated substantially flat band substantially parallel to said central axis and wound about said central axis in a helical configuration between said intermediate portion and said second end and in a spiral configuration between said intermediate portion and said first end, said second band having a first end portion adjacent to said linear actuator first end and a second end portion attached to said second frame portion;

a support member carried by said rotor in a helical pattern about said central axis, with part of said first band movably engaging said support member and allowing rotation of said rotor member relative to said first band;

a guiding member at said linear actuator intermediate portion and carried by said rotor member, said guiding member guiding said second band in a transition between its said spiral and helical configurations, said guiding member guiding each turn of said second band substantially edgewisely adjacent to the preceding turn of said second band between said intermediate portion and said second end when said rotor member is rotated in a first direction around said central axis, with said fasteners of said first band engaging and releasably linking each two consecutive turns of said second band between said intermediate portion and said second end thus forming a retractable telescopic column composed of the releasably interconnected first and second bands between said intermediate portion and said second end, with said first and said second bands each being independently stackable between said intermediate portion and said first end; and a retaining member retaining said first and second bands in their releasably interconnected relationship between said intermediate portion and said second end.

15. A linear actuator as defined in claim 14, wherein each said two consecutive turns of said second band that form said retractable telescopic column partly overlap to form an overlapping section, with a portion of said first band being wound in a helix adjacent to said overlapping section and with said fasteners engaging said overlapping section to releasably link said each two consecutive turns of said second band that form said retractable telescopic column.

16. A linear actuator as defined in claim 15, wherein said releasable fasteners are longitudinally spaced-apart teeth protruding from said first band, and said second band comprises longitudinally disposed openings positioned in said each two consecutive turns of said second band that form said retractable telescopic column so as to register in said overlapping section by pairs, with at least some of said pairs of openings being each engaged by a corresponding said tooth.

17. A linear actuator as defined in claim 16, wherein said retaining member is a punctual abutment member mounted to said rotor that prevents disengagement of said teeth of said first band from the turn of said second band forming said telescopic column nearest said intermediate portion, with the other turns of said second band forming said telescopic column being securely engaged by said teeth of said first band as long as said turn of said second band forming said telescopic column nearest said intermediate portion remains engaged by said teeth.

18. A linear actuator as defined in claim 17, wherein said retaining member is also said guiding member.

19. A linear actuator as defined in claim 17, wherein said retaining member is a roller.

20. A linear actuator as defined in claim 18, further comprising a second guiding member mounted to said rotor for guiding said second band at said linear actuator intermediate portion.

21. A linear actuator as defined in claim 20, wherein said second guiding member is a spring-loaded guide arm pivotally mounted to said rotor.

22. A linear actuator as defined in claim 14, further comprising a first anti-rotation member attached to either one of said first and second bands and engaging a second anti-rotation member attached to said frame, wherein said first and second bands are prevented from rotating while they are moved between their extended and retracted positions.

23. A linear actuator as defined in claim 16, wherein said teeth are also first anti-rotation members that cooperate with second anti-rotation members provided on said frame in spaced-apart fashion around said central axis, with at least one of said teeth engaging a corresponding space defined between two said second anti-rotation members at all times, whereby said first and second bands are prevented from rotating.

24. A linear actuator having a central axis and comprising:

a frame including spaced-apart and distinct first and second frame portions;

an elongated fastening band comprising a first portion of variable length stacked in a helical configuration and a second portion of variable length also having a helical configuration, said fastening band further comprising longitudinally disposed first releasable fastening means and having a first end located near said first frame portion and a second end attached to said second frame portion;

an elongated substantially flat structural band having its turns generally parallel to said central axis and comprising a first portion of variable length stacked in a spiral pattern separately from said fastening band and having a first end located near said first frame portion, a second portion of variable length having a helical configuration and having a second end attached to said second frame portion, and second releasable fastening means that can cooperate with said first fastening means to releasably interlock said structural and fastening bands;

a support member carried by said first frame portion and forming a helical pattern about said central axis, with part of said fastening band movably engaging said support member whilst allowing relative rotation of said support member relative to said fastening band;

a guiding and retaining member mounted to first frame portion; and drive means to cause relative rotation on one hand of said fastening and horizontal bands and on the other hand of said support member about said central axis; wherein upon relative rotation on one hand of said fastening and structural bands and on the other hand of said support member in a first direction, a retractable telescopic column is formed with the second portions of said fastening and structural bands, by said fastening band being lifted and its turns being spaced through its engagement on said support member, and by each turn of said structural band being guided by said guiding and retaining member into an edgewisely adjacent configuration with respect to the preceding turn of said vertical band to form a substantially continuous cylindrical wall of said column, with said first and second fastening means engaging each other to releasably link each two successive turns of the second portion of said structural band with a corresponding turn of said fastening band, and with said guiding and retaining member retaining said first and second fastening means in their engagement at said each two successive turns of the upper portion of said structural band; and wherein upon rotation of said rotor in the direction opposite said first direction, said retractable telescopic column is retracted.

25. A linear actuator as defined in claim 24, wherein each said two consecutive turns of said structural band that form said retractable telescopic column partly overlap to form an overlapping section, with a portion of said fastening band being wound in a helix adjacent to said overlapping section and with said first and second fastening means engaging each other at said overlapping section to releasably link said each two consecutive turns of said structural band that form said retractable telescopic column.

26. A linear actuator as defined in claim 25, wherein said first fastening means comprise longitudinally spaced-apart teeth protruding from said fastening band, and said second fastening means comprise spaced-apart openings longitudinally disposed along said structural band and positioned in said each two consecutive turns of said structural band that form said retractable telescopic column so as to register in said overlapping section by pairs, with at least some of said pairs of openings being each engaged by a corresponding said tooth.

27. A linear actuator as defined in claim 26, wherein said guiding and retaining member is a punctual abutment member mounted to said rotor that prevents disengagement of said teeth of said fastening band from the turn of said structural band forming said telescopic column nearest said structural band first portion, with the other turns of said structural band forming said telescopic column being securely engaged by said teeth of said fastening band as long as said turn of said structural band forming said telescopic column nearest said structural band first portion remains engaged by said teeth.

28. A linear actuator as defined in claim 27, wherein said guiding and retaining member is a roller.

29. A linear actuator as defined in claim 28, further comprising an additional guiding member mounted to said rotor for guiding said second band towards the telescopic column.

30. A linear actuator as defined in claim 24, further comprising a first anti-rotation member attached to either one of said structural and fastening bands and engaging a second anti-rotation member attached to said frame, wherein said structural and fastening bands are prevented from rotating.

31. A linear actuator as defined in claim 26, wherein said teeth are also first anti-rotation members that cooperate with second anti-rotation members provided on said frame in spaced-apart fashion around said central axis, with at least one of said teeth engaging a corresponding space defined between two said second anti-rotation members at all times, whereby said structural and fastening bands are prevented from rotating.

32. A linear actuator as defined in claim 25, wherein said structural band is preformed in an inclined configuration so that each turn defines a slightly conical shape.

33. A linear actuator as defined in claim 24, wherein said drive means includes a power driven rotor rotatably mounted to said first frame portion and carrying said guiding and retaining member and said support member, said linear actuator also comprising a structural band magazine movable relative to said rotor and said frame and carrying said structural band first portion.

34. A linear actuator as defined in claim 24, wherein said first frame portion carries said guiding and retaining member and a structural band magazine movable relative to said first frame portion and carrying said structural band first portion, with said second frame portion carrying said drive means that includes a power driven rotor fixedly attached to said first end of said fastening and structural bands and rotatably carried by said second frame portion.

* * * * *